US007252254B1

(12) United States Patent
Engel et al.

(10) Patent No.: US 7,252,254 B1
(45) Date of Patent: Aug. 7, 2007

(54) PILL CRUSHER AND SPLITTER

(75) Inventors: Mark Engel, Encino, CA (US); Song Yang, Shanghai (CN); Xuebo Wang, Shanghai (CN); Qiulin Bao, Shanghai (CN)

(73) Assignee: Tiger Medical Products (US), Inc., Encino, CA (US)

( * ) Notice: Subject to any disclaimer, the term of this patent is extended or adjusted under 35 U.S.C. 154(b) by 0 days.

(21) Appl. No.: 11/335,145

(22) Filed: Jan. 19, 2006

(51) Int. Cl.
*B02C 1/00* (2006.01)

(52) U.S. Cl. ..... 241/168; 241/169.2

(58) Field of Classification Search ..... 241/168, 241/169, 169.2, DIG. 27; 225/103, 104, 225/96.5, 105; 30/124, 134, 135; 100/292, 100/291, 293, 902
See application file for complete search history.

(56) References Cited

U.S. PATENT DOCUMENTS 3,915,393 A 10/1975 Elkins
4,694,996 A * 9/1987 Siegel ..... 241/100
4,763,847 A 8/1988 Vosburgh
5,118,021 A 6/1992 Fiocchi
5,513,810 A * 5/1996 Lin ..... 241/95
5,531,386 A 7/1996 Jensen
5,915,637 A 6/1999 Parsons
5,944,243 A 8/1999 Weinstein
6,059,209 A * 5/2000 Barson ..... 241/168
6,474,525 B1 11/2002 Reitano
6,523,766 B1 * 2/2003 Watt ..... 241/262
6,527,155 B2 3/2003 Buckley et al.
6,601,746 B2 8/2003 Buckley et al.
D497,543 S 10/2004 Buckley

* cited by examiner

*Primary Examiner*—Faye Francis
(74) *Attorney, Agent, or Firm*—Fattibene & Fattiben; Paul A. Fattibene; Arthur T. Fattibene

(57) ABSTRACT

A pill or tablet crusher and splitter using a combination lever and screw action. A lever attached to a ring having an internal screw thread advances a transversely movable platen towards a transversely fixed or placed anvil crushing a pill or tablet placed between the platen and anvil. The anvil may be removable for easy cleaning. A pill or tablet splitter may be placed in a sunken area beneath an intermediate portion of the lever. The pill or tablet splitter has a tray with a plurality of slopped bottom V-shaped pill or tablet holding clamps. A blade attached to a cover-cutter is placed over the tray. The cover-cutter is forced downward by the movement of the lever splitting or cutting the pills or tablets.

18 Claims, 8 Drawing Sheets

PILL CRUSHER AND SPLITTER

FIELD OF THE INVENTION

This invention relates generally to a pill crushing and splitting apparatus, and more particularly to a pill crushing and splitting apparatus having a mechanical advantage utilizing a lever and screw. It is intended to give an effective, easy to use and two-in-one solution to the care providers or patients who need to crush pills for powders or split pills for particular medicament purposes.

BACKGROUND OF THE INVENTION

In many cases, medicines come in the form of pills or tablets. Often, neither of these forms meets clinical application requirements. In some cases, the sizes of the pills or tablets are too big to easily swallow in their whole form or are too strong a dosage in some cases. For example, many patients such as children, some geriatrics, or other patients with particular diseases have difficulty swallowing whole pills or tablets. Hence it has been recognized that there is a need in these circumstances to crush pills or tablets medicines into powder and then mix them with food, such as applesauce or jelly or added to a liquid in order to be easily swallowed or better digested.

The need to sometimes split pills or tablets is also long established. According to the Academy of Managed Care Pharmacy, pill splitting is a viable means of reducing the cost of the medicine while maintaining the desired therapy when those medications with multiple dosage strengths are priced essentially the same (Policy Digest and Practice Advisory, April 2001). In sum, some people/patients prefer to break "larger size" pills like vitamin into "small" pieces to swallow easier, while some patients would like to order a larger size of the tablets or pills and then split them simply for economic considerations.

A number of "pill crushers" and "pill splitters" are currently available on the marketplace. Generally speaking, the two functions, crushing and splitting, are provided separately. Most of the splitters are portable and designed for individual usage, while various designs of pill crushers are provided to both professional healthcare providers and to the general population for personal use.

Conventional pill crushers rely on various mechanisms including the use of a mortar and pestle for grinding or impacting. Additionally, there have been used various manual or motor driven devices to abrade, compress, fracture or crush the pills or tablets into either fragments or powder. However, all of the current commercial products have certain weaknesses in terms of reliability and efficacy of crushing pills or tablets, particularly for professional care providers which require heavy duty solutions.

For example, U.S. Pat. No. 5,915,637, issued on Jun. 29, 1999 to J. Stuart Parsons, discloses a pill crusher whose operating mechanism is to convert the rotational movement of the handle into the "V" movement of the plates that is pivotally connected with the handle and the base for crushing pills between the plates and the anvil which is vertically fixed to the elongated base. A pouch for receiving the pills to be crushed has also been provided with the apparatus. In this prior apparatus, the crushing action from the "V" movement of the plates to the anvil is not sufficient to pulverize the pills into desired powders in a single action. Repetition is inevitable to get the desired powder. In addition, it is difficult to clean the crushing area during regular maintenances or if the pill pouches are accidentally opened or split. As a result, cross contamination of medicines is possible due to the difficulty in cleaning.

Most of the pill splitters on the market are portable designs for individual and home usage. Some of them rely on impact forces on the blade via pivot connections or simply by manual pressure. Some of them are universal designs adapted for use with the diverse shapes of pills. Known examples of prior art pill splitting devices include U.S. Pat. No. 5,038,475; U.S. Pat. No. 4,763,986; U.S. Pat. No. 6,474,525; and U.S. Pat. No. 5,944,243.

However, there is still a need for a durable commercially oriented pill splitter that can split numerous varieties of pills and tablets in a fast, easy to operate, strength saving, accurate and reliable manner. For example, care providers in nursing homes may need an efficient and reliable way to split various pills or tablets for geriatrics with different medical conditions. In such a situation there is a need for a device designed for large-scale or large volume pill splitting. A multi tablet cutter is currently available on the market for the fast cutting of pills. This multi tablet cutter is sold under the trademark TRU-CUT and is disclosed in U.S. Pat. No. 6,527,155. Its principal design is simply like a "hay cutter" with a tablet-holding tray. However, this sequential cutting action of the pills may potentially results in a cut that is not precise. In addition, pieces of a pill may split during this "fast" cutting action, which is less than ideal in therapeutic terms. It is a difficult problem to balance between accuracy and the speed of cutting.

The two significant functions, crushing and splitting, are provided separately in most of the available apparatus. Only few portable devices have the two-in-one design such as a device sold by Med Sun as a deluxe cutter/crusher. However, the personal use design of this product limits its application in high volume commercial use.

Therefore, with consideration to the previous discussion of the prior art, there is a need for a device that is compact and universal in design for crushing and splitting the various shapes of pills or tablets, and operates in an easy but reliable, quiet, strength saving, and efficient manner, and is easy to maintain and clean, and is suitable for both individual and institutional usage, and effectively reduces the likelihood of the contamination of the pills or tablets.

In summary, there is a need for a pill crusher to overcome most of the shortcomings of existing devices. There is a need for an apparatus that is easy to use, strong, reliable, and easy to clean and maintain.

SUMMARY OF THE INVENTION

The invention disclosed herein simply meets all of the above requirements and provides a one-stop solution to both pill or tablet crushing and pill or tablet splitting, particularly for professional care providers.

A lever and screw combination is used to uniformly advance a platen to crush a pill. A transversely mounted splitter is driven by the lever to simultaneously split a plurality of pills or tablets.

The preferred embodiment of the present invention is a two-in-one pill crusher and splitter that has a molded rectangular base integrally with a vertical concaved plate opposite to two slotted pillars at one end, a sunken area in the middle and a pouch dispenser at the other end. An axle together with a square plate is fixed in the center of the concaved plate. A bushing and an external ring with an internal screw thread is coupled to the axle, around which the bushing rotates to move the internal screw forward along two slide ways on the base rather than counter-rotate with the bushing. A mating external screw is formed with an "L" shape platen for crushing a pill in a pouch against a removable anvil that is fixed by the two slotted pillars. A handle is affixed with the external ring to rotate the external ring causing the platen to advance uniformly towards the anvil.

There is a resilient or rubber mat under the middle part of the handle for pushing a splitter that includes a cover-cutter and a mated pill holding tray in the sunken area in transversely positioned in the middle of the base. Several "V" shaped holders adapted to fix or clamp onto a pill are formed in the pill holding tray securely hold diverse shapes of pills for splitting. The pressure from the rotation movement of the handle on the cover-cutter will create the cutting action of a blade under the cover-cutter to split the pills held in the pill holding tray. A closely conforming disposable plastic insert tray may be placed in the pill holding tray so as to prevent cross contamination.

A number of advantages are credited to the preferred embodiment of the invention. Firstly, a two-in-one design gives the care provider a one-stop solution for pill splitting and crushing. Secondly, it affords the users substantial mechanical benefits from the screw rotation since it provides a strength-saving and ergonomic way to operate. Finally, but not lastly, its reliability, efficacy, flexibility and ease of maintenance and cleaning enable the users a superior manner of both pill crushing and pill splitting, particularly in a commercial environment.

Accordingly, it is an object of the present invention to provide a combination pill crusher and splitter that is efficient and easy to use.

It is an advantage of the present invention that a pill is evenly crushed.

It is a feature of the present invention that a lever and screw mechanism is used.

These and other objects, advantages, and features of the present invention will become more fully apparent from the following drawings, detailed description and appended claims.

BRIEF DESCRIPTION OF THE DRAWINGS

The detailed description and accompanying drawings give a complete understanding of the preferred embodiment of the invention with the drawings identified below.

DETAILED DESCRIPTION OF THE PREFERRED EMBODIMENT

The preferred embodiment of the invention described below is simply for illustrative purpose and not restrictive to any other forms departing from its essentials. Reference numbers indicated in the accompanying drawings illustrate the components, structure, and operation mechanism of the preferred embodiment of the invention. The numeral 10 is directed to the whole apparatus and the numeral 100 refers to the splitter part according to the present invention.

Figure 1:
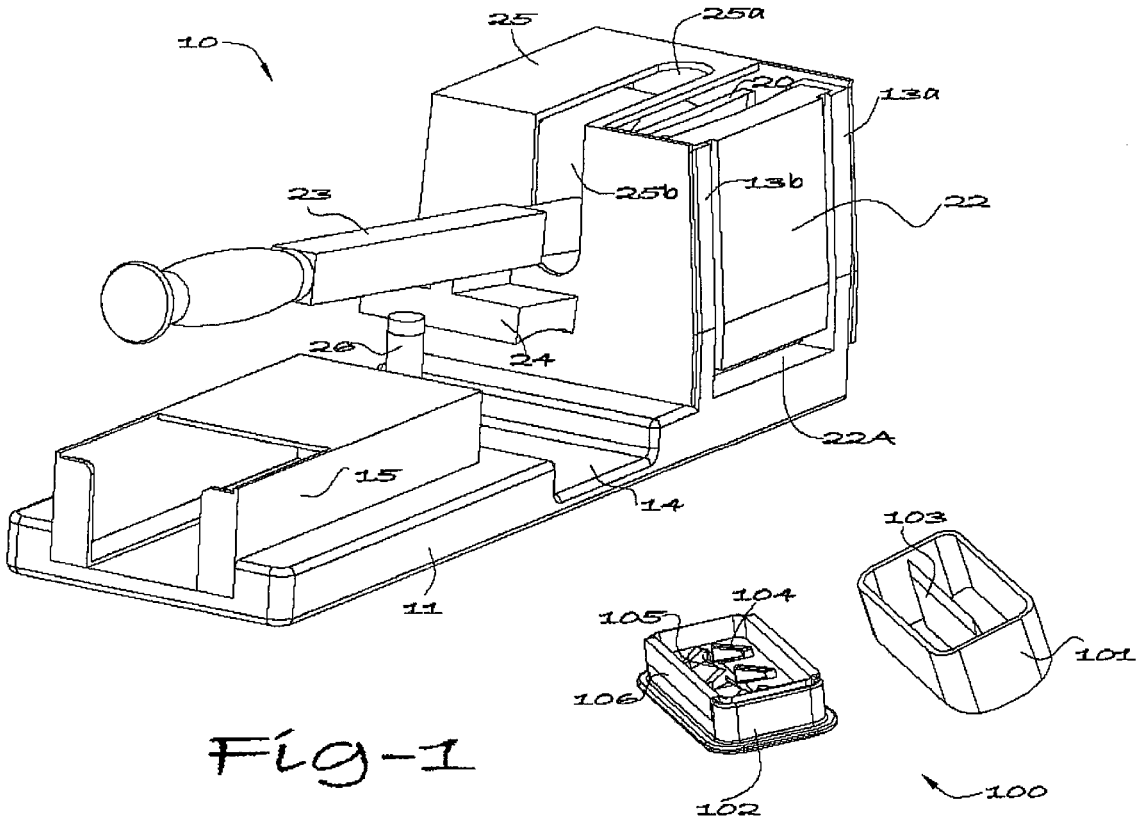
FIG. 1 is a perspective view of the apparatus of the present invention.
Figure 2:
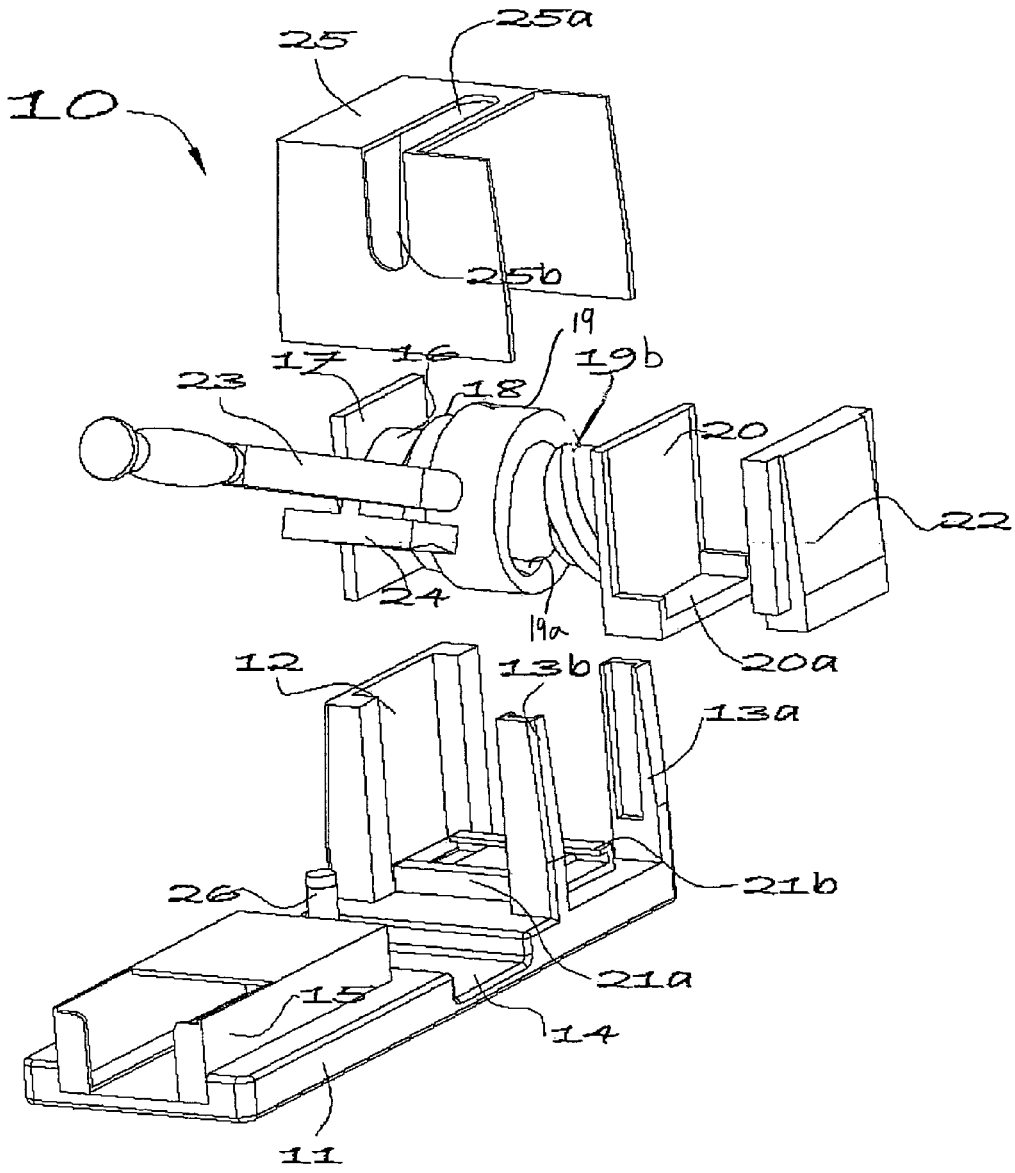
FIG. 2 depicts an unassembled view of the parts of the apparatus shown in FIG. 1.

The main components of the apparatus are illustrated in FIG. 1 and FIG. 2. The pill crusher and splitter 10 includes a rectangular base 11 with an integral concaved or channeled plate 12 opposite two integral slotted pillars 13*a* and 13*b* at the rear end, a sunken area 14 in the middle as a runway for holding the splitter 100, and a pouch dispenser 15 with a rubber stopper 26 at the other end. The inside ring of an axletree or axle 16 is fixed to a foursquare or square plate 17 via a steel shaft, not shown. The axle 16 and square plate 17 may also be formed from one piece of material, preferably steel. The plate 17 is then riveted on the center of the concaved or channeled plate 12. A bushing 18 is attached to external ring 19 with internal screw threads 19*a*. The bushing 18 is coupled to the axletree or axle 16 to facilitate the rotational movement of the bushing around the axle 16. As the lever 23 is moved, the internal screw 19*a* moves the external screw threads 19*b* and is moved forward or laterally along two slide ways 21*a* and 21*b* on the base 11. An "L" shape platen 20 is formed with the outside end of the external screw 19*b*, while the platen 20 and leg 20*a* move against anvil 22 fixed in between the two slots 13*a* and 13*b*. Thereby the movable platen 20 and laterally fixed anvil 22 create a compressible space along with the forward-backward movement of the screw-platen assembly 19*a*, 19*b*, 20. The component nature of the screw-platen assembly also facilitates cleaning and maintenance. When the vertically removable anvil 22 is fully inserted into the slots 13*a* and 13*b*, a gap 22A between the anvil 22 and the base 11 is left to hold the bottom side or leg 20*a* of the platen 20 during the crushing action. In another embodiment, the anvil 22 may be fixed and not made removable.

A handle 23 is affixed to the bushing 18 and external ring 19 for controlling its rotation movement. A housing 25 covers the above described screw-pressing transmission parts on the top, and two "U" gaps 25*a* and 25*b* are left for the handle's rotational movement.

There is a rubber mat 24 under the middle part of the handle 23 for pressing the splitter 100 placed in the sunken area 14 along with the handle's rotation movement. The splitter 100 includes a cover-cutter 101 with a blade 103 inside and a mated pill holding tray 102 with sloped pill holders 105 having "V" shaped fixed clamps 104 for holding diverse shapes of the pills or tablets. A disposable tray 106 is embedded into the said tray 102 for preventing cross contamination from different splitting operations.

The operation mechanism will now be discussed. The device utilizes the rotation movement of the bushing 18 and external ring 19 to create the rotation force for its internal screw 19*a*. The rotation force is converted into forward or lateral movement of the external screw 19*b* along two slide ways 21*a* and 21*b* on the base. This causes the attached movable platen 20 to move towards laterally fixed anvil 22 for crushing the pills there between.

Figure 3A:
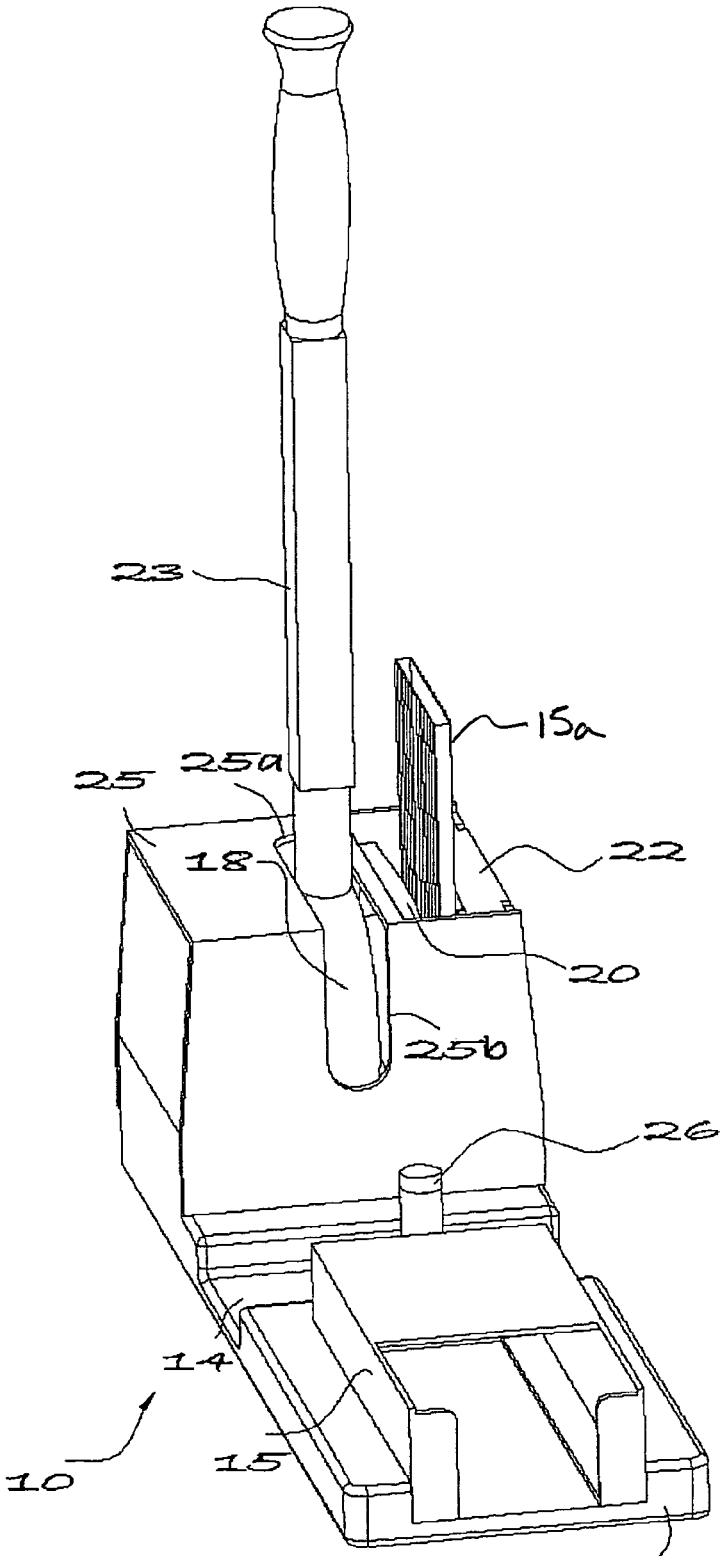
FIG. 3*a* is a perspective view of the apparatus shown in FIG. 1 with the handle in an uplifted position and a pouch loaded in a position for crushing.
Figure 3B:
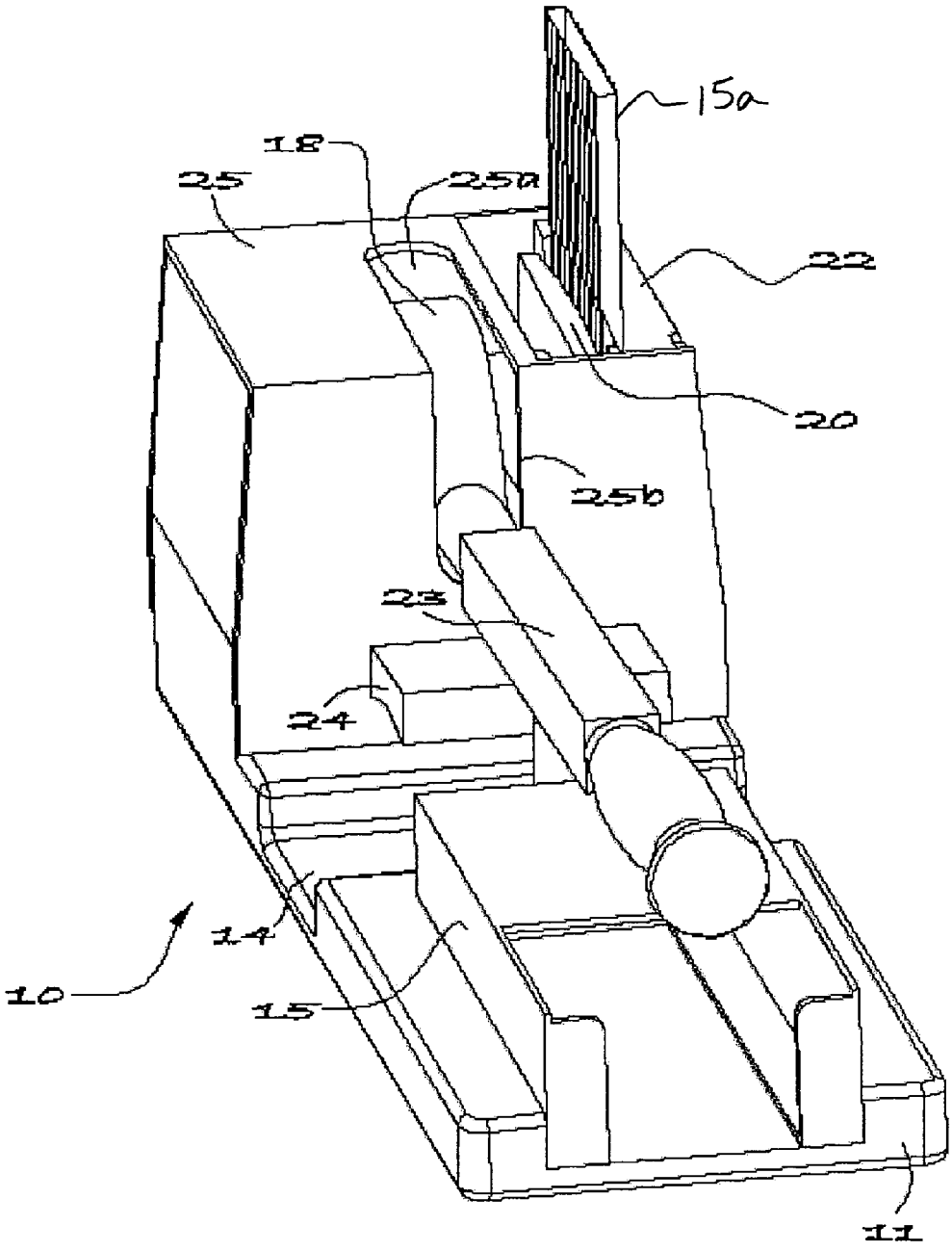
FIG. 3*b* is a perspective view of the apparatus shown in FIG. 3*a* when the crushing is finished.

FIGS. 3*a* and 3*b* illustrate the pill crushing operation of the present invention and the movement of handle 23. With the handle 23 in a raised position as illustrated in FIG. 3*a*, a pouch 15*a* containing a pill or tablet to be crushed is placed in an opening between the transversely fixed anvil 22 and the lateral or transversely movable platen 20. Upon lowering the handle 23, the transversely movable platen 20 moves towards the lateral or transversely fixed anvil 22 causing the pill or tablet in pouch 15*a* to be crushed.

Figure 4A:
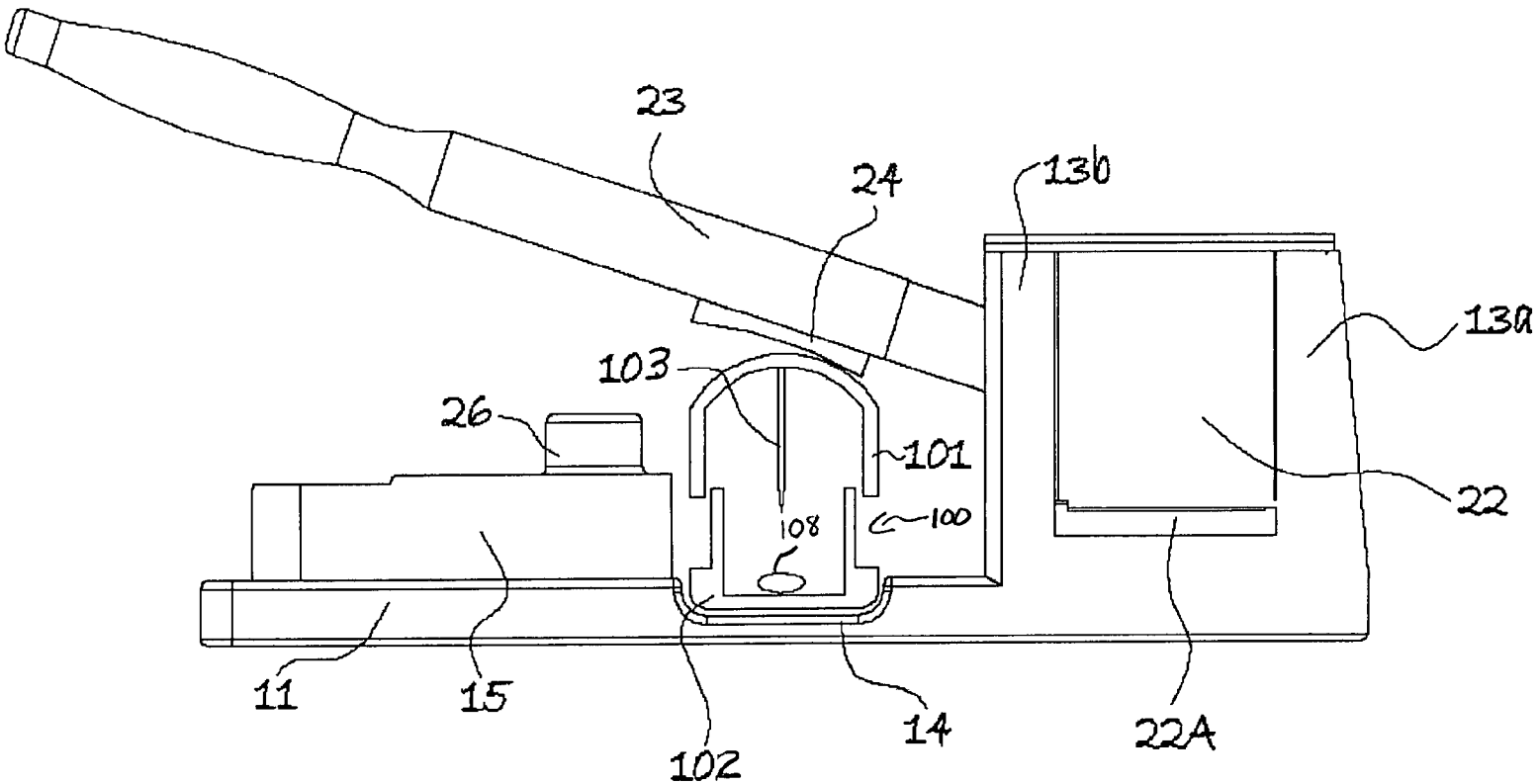
FIG. 4*a* schematically illustrates in cross-section along the long line or longitudinally of the apparatus shown in FIG. 1 when the pill splitter is in position for push-cutting or splitting.
Figure 4B:
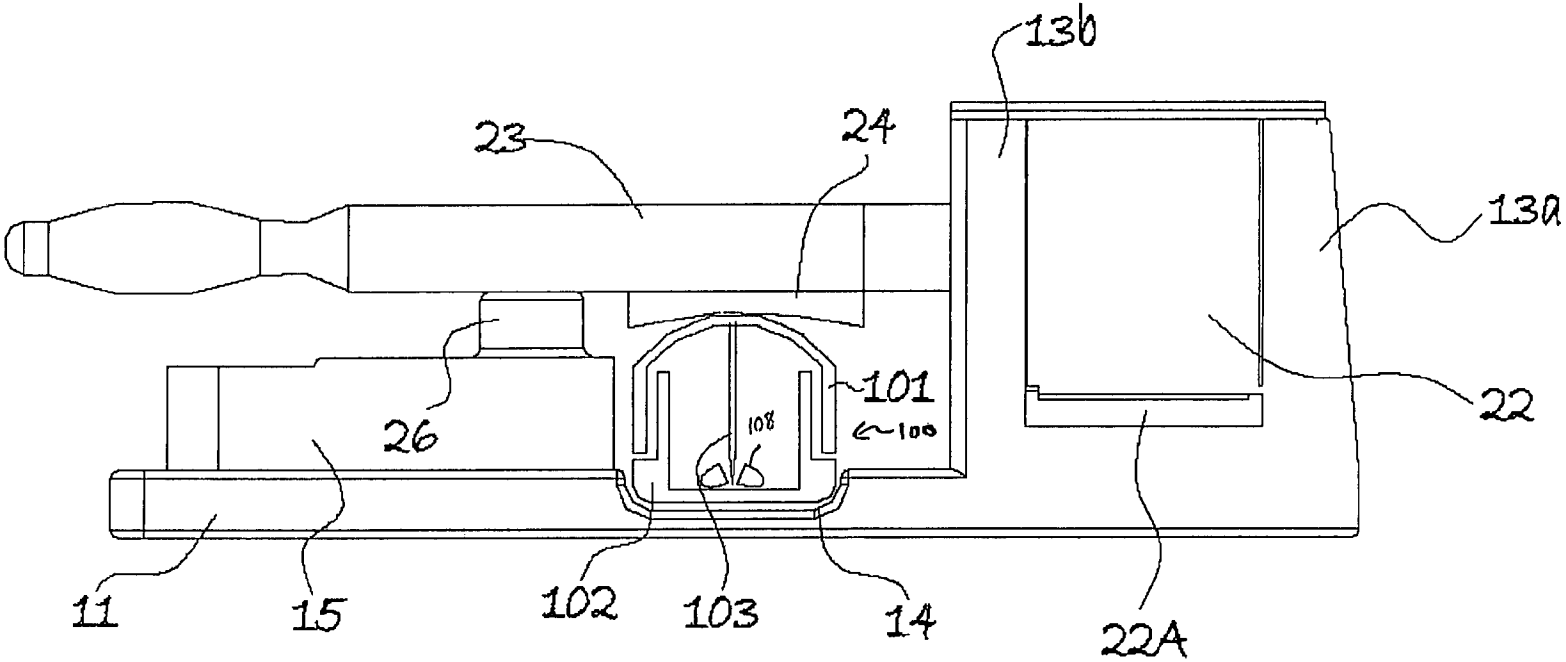
FIG. 4*b* shows the view of FIG. 4*a* when the push-cutting or splitting is done.

FIGS. 4*a* and 4*b* illustrate the pill splitting operation of the present invention and movement of handle 23. With the splitter 100 in position in sunken area 14 and a pill or tablet 108 held in position, the lever 23 is lowered. The rubber mat 24 on lever 23 contacts the cover-cutter 101 causing it to lower. Blade 103 is caused to lower cutting or splitting pill or tablet 108.

Figure 5A:
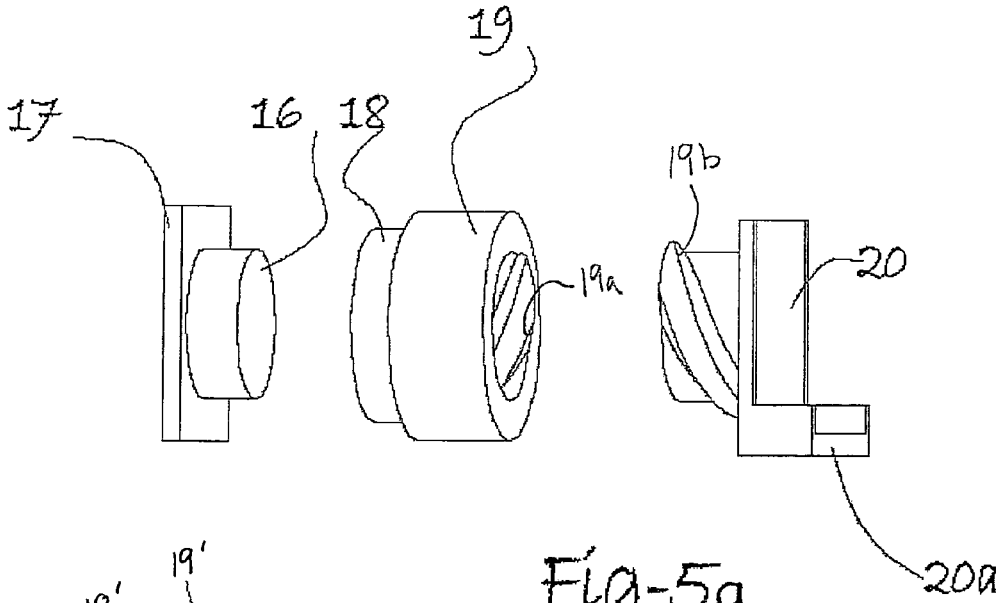
FIG. 5*a* schematically illustrates in perspective view of the screw assembly.
Figure 5C:
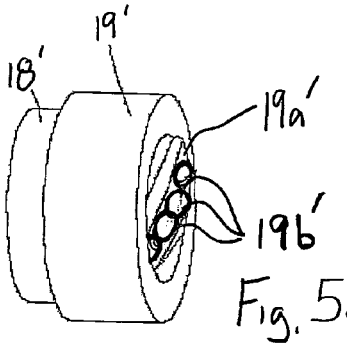
FIG. 5*c* schematically illustrates an embodiment of a portion of the screw assembly using ball bearings.
Figure 5B:
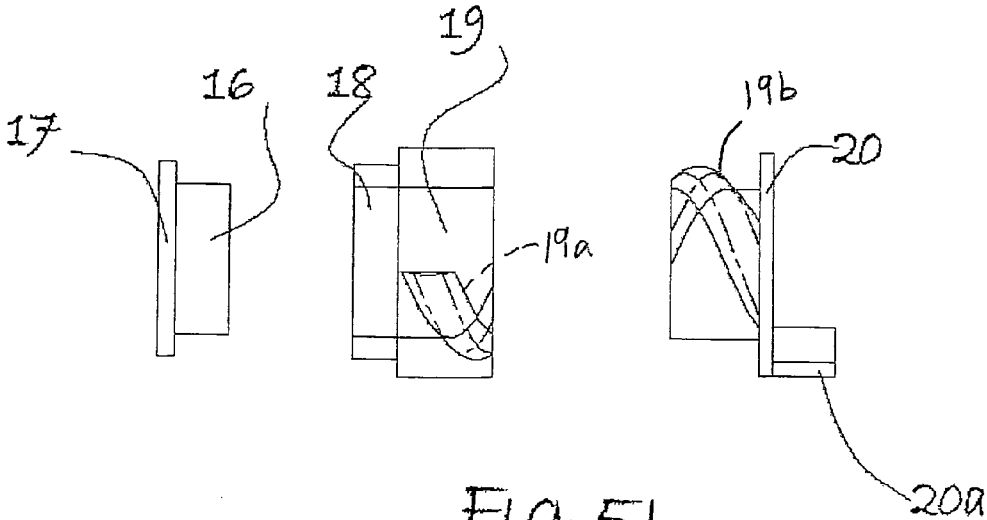
FIG. 5*b* schematically illustrates in elevational view of the screw assembly.

FIGS. 5*a* and 5*b* illustrate the axle-screw assembly in greater detail. FIG. 5*a* is a perspective and FIG. 5*b* is an elevational view. FIGS. 5*a* and 5*b* more clearly illustrate the external ring 19 and the internal screw threads 19*a* and the mating external screw threads 19*b* on the transversely movable platen 20. In operation, the lever 23, illustrated in FIGS. 1-4*b*, is attached to the external ring 19. Movement of the lever 23 causes the external ring 19 and attached bushing 18 to rotate on the axle 16. The external screw threads 19*b* are fixed to the platen 20. The platen 20 is prevented from rotating and is permitted to slide transversely in slide ways 21*a* and 21*b*, illustrated in FIG. 2. Therefore, as the external ring 19 is rotated, the platen 20 is moved transversely.

FIG. 5*c* illustrates another embodiment of the external ring 19' and attached bushing 18' of an axle-screw assembly. In this embodiment, steel ball bearings 19*b*' are placed and held in the internal screw threads 19*b*'. The use of the ball bearings 19*b*' helps to reduce frictional forces from the screw rotation and provides enhanced durability and ease of use.

Figure 6:
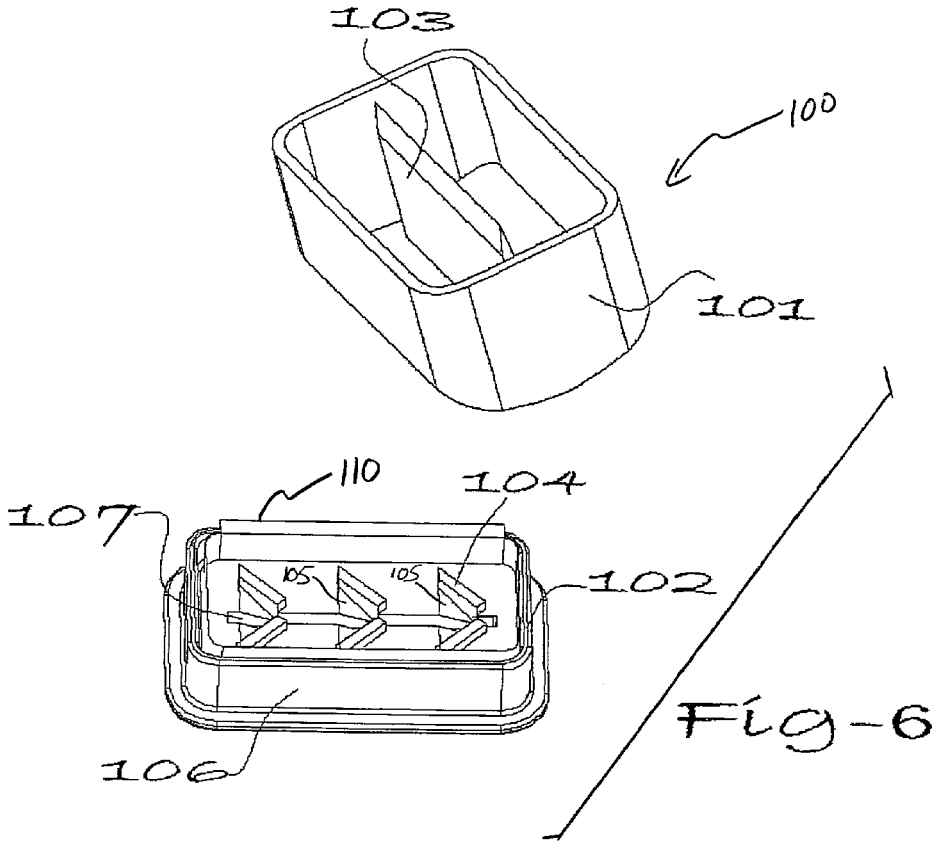
FIG. 6 is a perspective view illustrating a pill splitter incorporated in the present invention.

FIG. 6 more clearly illustrates the splitter assembly 100. The tray 106 has a plurality of V-shaped clamps 104 formed therein. On the base of the pill holding tray 102 between the V-shaped clamps 104, the bottom 105 is sloped towards the vertex of the V-shaped clamps 104. The sloped bottom 105 aids in retaining the pill or tablet into or against the vertex of the V-shaped clamps 104 during cutting or splitting. A slot 107 extends between the vertex of each of the V-shaped clamps 104 to receive the edge of the blade 103 during cutting. This assures that the pill or tablet is completely cut. A disposable insert tray 110 may be inserted into the tray 106. Preferably, the tray 106 is made of a durable material, such as a metal, and the disposable insert tray 110 is made of an inexpensive material, such as plastic or paper. The disposable insert tray 110 closely conforms or is molded to the shape of the tray 106 and is used to hold the split pills and prevent cross contamination when used with different types of pills.

From the foregoing description, it is clear that the current invention provides a compact platform for crushing or splitting pills/tablets primarily for institutional usage but also easy enough for personal use. It is ergonomically simple and reliable to operate. Improvements and modifications from the present invention may be defined in the following claims.

While the present invention has been described with respect to several different embodiments, it will be obvious that various modifications may be made without departing from the spirit and scope of this invention.

What is claimed is:

1. A pill crusher or splitter comprising:
a base;
a movable platen;
an anvil;
a ring having an internal screw thread;
a lever attached to said ring; and
an external screw thread attached to said movable platen and adapted to be received by the internal screw thread of said ring,
whereby when said lever is moved said ring rotates causing said movable platen to advance towards said anvil crushing a pill placed there between.

2. A pill crusher or splitter as in claim 1 further comprising:
a pill splitter placed on said base adjacent an intermediate portion of said lever,
whereby when said lever is moved said lever contacts said pill splitter.

3. A pill crusher or splitter as in claim 2 wherein said pill splitter comprises:
a tray having a bottom;
a plurality of V-shaped clamps formed in the bottom of said tray;
a cover adapted to fit over said tray; and
a blade placed in said cover and aligned to contact a pill placed in one of said plurality of V-shaped clamps.

4. A pill crusher or splitter as in claim 3 further comprising:
a slope formed in the bottom of said tray adjacent each vertex of said plurality of V-shaped clamps.

5. A pill crusher or splitter for crushing pills or tablets used for medical purposes comprising:
a base;
a plate attached to said base;
a pair of pillars attached to said base opposite said plate;
an anvil transversely fixed between said pair of pillars;
an axle attached to said plate;
a ring adapted to rotate about said axle, said ring having internal screw threads;
a platen attached to external screw threads placed opposite said anvil, the external screw threads adapted to mate with the internal screw threads of said ring; and
a lever attached to said ring,
whereby when said lever is moved said ring rotates causing said platen to move towards said anvil crushing a pill placed there between.

6. A pill crusher or splitter as in claim 5 further comprising:
a pill splitter placed on said base adjacent an intermediate portion of said lever,
whereby when said lever is moved said lever contacts said pill splitter.

7. A pill crusher or splitter as in claim 6 wherein said pill splitter comprises:
a tray having a bottom;
a plurality of V-shaped clamps formed in the bottom of said tray;
a cover adapted to fit over said tray; and
a blade placed in said cover and aligned to contact a pill placed in one of said plurality of V-shaped clamps.

8. A pill crusher or splitter as in claim 7 further comprising:
a slope formed in the bottom of said tray adjacent each vertex of said plurality of V-shaped clamps.

9. A pill crusher or splitter as in claim 5 wherein:
said platen comprises an L-shape.

10. A combination pill crusher and splitter comprising:

a base;

an anvil attached to said base;

a platen placed adjacent said anvil;

a screw assembly placed between said anvil and said platen;

a lever attached to said screw assembly, whereby when said lever is moved said screw assembly causes said platen to move towards said anvil; and a pill splitter placed under said lever and positioned to contact an intermediate portion of said lever when said lever is moved, whereby movement of said lever performs the duel function of crushing a pill placed between said anvil and said platen and splits a pill placed in said pill splitter.

11. A combination pill crusher and splitter as in claim 10 wherein said pill splitter comprises:

a tray having a bottom;

a plurality of V-shaped clamps formed in the bottom of said tray;

a cover adapted to fit over said tray; and a blade placed in said cover and aligned to contact a pill placed in one of said plurality of V-shaped clamps.

12. A combination pill crusher and splitter as in claim 11 further comprising:

a slope formed in the bottom of said tray adjacent each vertex of said plurality of V-shaped clamps.

13. A combination pill crusher and splitter as in claim 11 further comprising:

a disposable insert tray placed in the bottom of said tray.

14. A combination pill crusher and splitter comprising:

a base having a front end and a back end;

a sunken area formed intermediate the front end and the back end;

a pouch dispenser in the front end of said base;

a pair of horizontal slide ways formed in the back end of said base;

a pair of vertical slotted pillars formed on the back end of said base;

a channeled plate attached to the back end of said base and positioned opposite said pair of vertical slotted pillars;

an anvil adapted to fit between said pair of vertical slotted pillars and to be transversely fixed;

a platen placed adjacent said anvil, said platen adapted to fit between said pair of horizontal slide ways and slide transversely therein;

an external screw thread attached to said platen;

a ring having an internal screw thread adapted to mate with said external screw thread;

a bushing attached to said ring;

a plate adapted to fit within said channeled plate an axle attached to said plate and adapted to receive said bushing;

a lever attached to said ring and positioned over said sunken area, whereby when said lever is moved said ring rotates and the internal screw thread forces said external screw thread and said platen to move towards said anvil;

a tray having a bottom placed in said sunken area;

a plurality of V-shaped clamps formed in the bottom of said tray, the bottom having a slope towards a vertex of each of said plurality of V-shaped clamps;

a cover adapted to fit over said tray; and a blade placed in said cutter and aligned to contact a pill placed in one of said plurality of V-shaped clamps, whereby movement of said lever performs the duel function of crushing a pill placed between said anvil and said platen and splits a pill placed in on of said plurality of V-shaped clamps.

15. A pill crusher and splitter comprising:

a rectangular base having slide ways and slotted pillars;

a pouch dispenser in a forward end of said rectangular base;

a sunken area in a middle of said rectangular base;

a screw assembly at a rear end of said rectangular base;

a handle attached to said screw assembly;

a platen sliding in the slide ways in said rectangular base and coupled to said screw assembly; and an anvil placed between the slotted pillars of said rectangular base, whereby when said handle rotates said screw assembly, said screw assembly causes said platen to move forward along the slide ways towards said anvil crushing a pill placed there between.

16. A pill crusher and splitter according to claim 15 further comprising:

a pill splitter with a cover-cutter and a mated pill holding tray with sloped V-shape clamps placed into the sunken area in the middle of said rectangular base, whereby a pushing force is created from the rotational movement of said handle splitting the pill.

17. A pill crusher and splitter according to claim 16 further comprising:

a disposable tray fitted into the mated pill holding tray, whereby various shapes of pills or tablets may be held.

18. A pill crusher and splitter according to claim 15 wherein said anvil is both attachable and detachable into the slotted pillars on said rectangular base, whereby the device may be easily maintained and also hold a pouch in a suitable position for crushing a pill.

* * * * *